United States Patent [19]

Mikoshiba et al.

[11] Patent Number: 4,723,855

[45] Date of Patent: Feb. 9, 1988

[54] COMPACT PRINTER

[75] Inventors: Hitoshi Mikoshiba; Hiroshi Takizawa, both of Nagano, Japan

[73] Assignee: Seiko Epson Corp., Tokyo, Japan

[21] Appl. No.: 820,282

[22] Filed: Jan. 17, 1986

[30] Foreign Application Priority Data

Jan. 17, 1985 [JP] Japan ..... 60-6127
Jun. 14, 1985 [JP] Japan ..... 60-129559

[51] Int. Cl.[4] ..... B41J 7/48

[52] U.S. Cl. ..... 400/154.5; 400/157; 400/568; 101/93.23; 318/696

[58] Field of Search ..... 101/93.09, 93.23; 400/154.5, 157, 568; 318/696

[56] References Cited

U.S. PATENT DOCUMENTS

| | | | |
|---|---|---|---|
| 3,848,527 | 11/1974 | Nihira | 101/93.23 |
| 4,286,202 | 8/1981 | Clancy et al. | 318/696 |
| 4,381,481 | 4/1983 | Kuppers et al. | 318/696 |
| 4,458,589 | 7/1984 | Watanabe et al. | 101/93.23 |
| 4,464,071 | 8/1984 | Sakakibara | 400/163 |
| 4,476,421 | 10/1984 | Moriguchi | 318/696 |
| 4,600,868 | 7/1986 | Bryant | 318/696 |

FOREIGN PATENT DOCUMENTS

| | | | |
|---|---|---|---|
| 3122985 | 12/1982 | Fed. Rep. of Germany | 400/568 |
| 152881 | 8/1984 | Japan | 400/568 |
| 162070 | 9/1984 | Japan | 400/568 |

OTHER PUBLICATIONS

Kuo, Theory & Application of Step Motors, West Publishing Co., New York, Jun. 1974, pp. 191–194.

*Primary Examiner*—William Pieprz
*Attorney, Agent, or Firm*—Blum, Kaplan, Friedman, Silberman & Beran

[57] ABSTRACT

A compact printer has a type drum having at least one row of types, the types, including at least one space, being arranged on the periphery of the drum at regular intervals. The type drum is rotated by a stepper motor and a hammer member is provided for moving a selected type towards the paper for printing. The stepper motor is turned by signals which correspond to each step necessary to move the type drum through at least one pitch distance between types. Ratchet teeth, moving with the type drum, can be engaged by a blocking lever when rotation of the type drum is reversed, so as to stop vibration of the type drum at the time of printing.

24 Claims, 13 Drawing Figures

FIG. 1
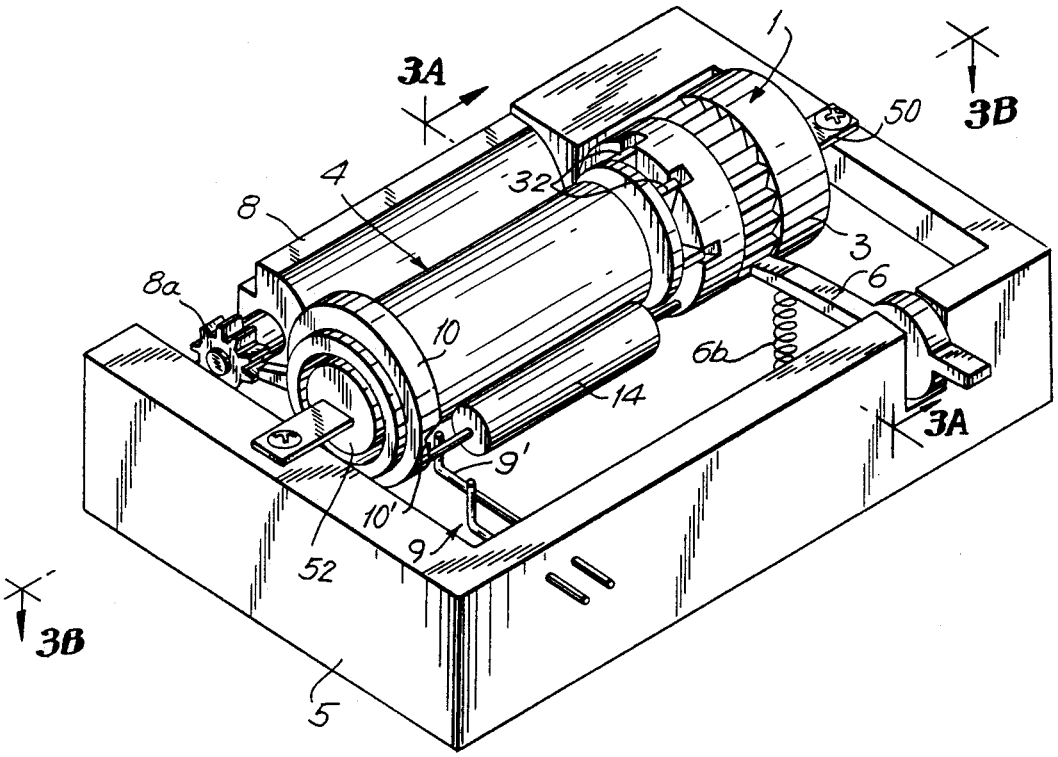
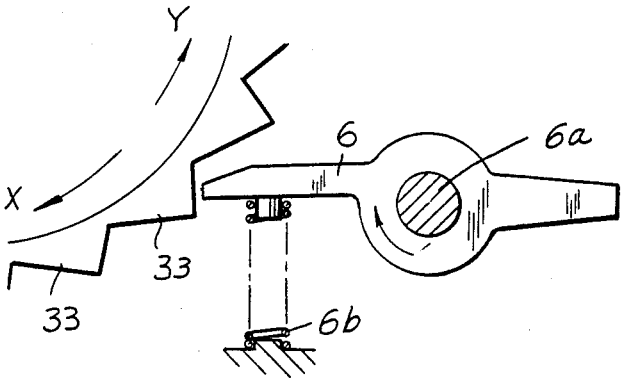
FIG. 2

FIG. 5

| COLUMN NUMBER 18 | 17 | 16 | 15 | 14 | 13 | 12 | 11 | 10 | 9 | 8 | 7 | 6 | 5 | 4 | 3 | 2 | 1 | CHARACTER POSITION | POWERING MODE |
|---|---|---|---|---|---|---|---|---|---|---|---|---|---|---|---|---|---|---|---|
| | | | | | | | | | | | | | | | | | | SPACE 3 | 8 |
| – | | – | | – | | – | | – | | – | | – | | – | | – | | EVEN – | 4 |
| | 0 | | 0 | | 0 | | 0 | | 0 | | 0 | | 0 | | 0 | | + | ODD 0 | 8 |
| 0 | | 0 | | 0 | | 0 | | 0 | | 0 | | 0 | | 0 | | G | | EVEN 0 | 4 |
| | 1 | | 1 | | 1 | | 1 | | 1 | | 1 | | 1 | | 1 | | × | ODD 1 | 8 |
| 1 | | 1 | | 1 | | 1 | | 1 | | 1 | | 1 | | 1 | | K | | EVEN 1 | 4 |
| | 2 | | 2 | | 2 | | 2 | | 2 | | 2 | | 2 | | 2 | | + | ODD 2 | 8 |
| 2 | | 2 | | 2 | | 2 | | 2 | | 2 | | 2 | | 2 | | √ | | EVEN 2 | 4 |
| | 3 | | 3 | | 3 | | 3 | | 3 | | 3 | | 3 | | 3 | | ◊ | ODD 3 | 8 |
| 3 | | 3 | | 3 | | 3 | | 3 | | 3 | | 3 | | 3 | | P | | EVEN 3 | 4 |
| | 4 | | 4 | | 4 | | 4 | | 4 | | 4 | | 4 | | 4 | | ✳ | ODD 4 | 8 |
| 4 | | 4 | | 4 | | 4 | | 4 | | 4 | | 4 | | 4 | | C | | EVEN 4 | 4 |
| | 5 | | 5 | | 5 | | 5 | | 5 | | 5 | | 5 | | 5 | | S | ODD 5 | 8 |
| 5 | | 5 | | 5 | | 5 | | 5 | | 5 | | 5 | | 5 | | 5/4 | | EVEN 5 | 4 |
| | 6 | | 6 | | 6 | | 6 | | 6 | | 6 | | 6 | | 6 | | T | ODD 6 | 8 |
| 6 | | 6 | | 6 | | 6 | | 6 | | 6 | | 6 | | 6 | | M | | EVEN 6 | 4 |
| | 7 | | 7 | | 7 | | 7 | | 7 | | 7 | | 7 | | 7 | | E | ODD 7 | 8 |
| 7 | | 7 | | 7 | | 7 | | 7 | | 7 | | 7 | | 7 | | △ | | EVEN 7 | 4 |
| | 8 | | 8 | | 8 | | 8 | | 8 | | 8 | | 8 | | 8 | | % | ODD 8 | 8 |
| 8 | | 8 | | 8 | | 8 | | 8 | | 8 | | 8 | | 8 | | R | | EVEN 8 | 4 |
| | 9 | | 9 | | 9 | | 9 | | 9 | | 9 | | 9 | | 9 | | = | ODD 9 | 8 |
| 9 | | 9 | | 9 | | 9 | | 9 | | 9 | | 9 | | 9 | | ↑ | | EVEN 9 | 4 |
| | ɔ | | ɔ | | ɔ | | ɔ | | ɔ | | ɔ | | ɔ | | ɔ | | # | ODD 10 | 8 |
| # | | ɔ | | ɔ | | ɔ | | ɔ | | ɔ | | ɔ | | ɔ | | + | | EVEN 10 | 4 |
| | • | | • | | • | | • | | • | | • | | • | | • | | – | ODD 11 | 8 |
| – | | • | | • | | • | | • | | • | | • | | • | | – | | EVEN 11 | 4 |
| | | | | | | | | | | | | | | | | | | SPACE 1 | 8 |
| | | | | | | | | | | | | | | | | | | SPACE 2 | 4 |

COMPACT PRINTER

BACKGROUND OF THE INVENTION

This invention relates to printer mechanisms. More particularly, the invention relates to printer mechanisms for compact printers in which a stepper motor rotates a type drum and feeds paper and in which type selection, printing, and paper feed are executed in one turn of the type drum (print cycle).

Miniature printers are known in which the driving force is provided by a single stepper motor which turns a type drum to position a type for printing and which also feeds the paper into printing position. In such printers, the step-wise advance provided by the stepper motor is employed in integral multiples to move the type drum the pitch distance between adjacent types in the peripheral direction of the drum. The positions of the types thus correspond to the positions at which the stepper motor can be stopped but not to the driving waveform. As shown in FIG. 10, the driving waveforms of the conventional stepper motor relate to the positions of the type series without relation to the kind of type. Accordingly, when it is desired to restart a conventional stepper motor which has been stopped for printing, it is necessary to base the generation of the waveform which drives the motor in its next step upon a stored version of the waveform which existed at the moment of stopping, thereby resulting in undesirable complexity in the circuit of the stepper motor. Further, because of stored angular momentum, the stepper motor and associated type drum of such systems are subject, after stopping, to residual vibration for a period of time while the stored energy dissipates. When a type is printed under the foregoing condition, printed characters can be improperly aligned with those in adjacent columns, so that the resulting printout has an inferior appearance. While the alignment can be improved by waiting to print until the vibration has ceased, the printing cycle is undesirably prolonged, giving a slow printer speed. Further, when large amplitude vibrations occur, the selected type may be missed by the printing hammer or there may be some other malfunction, and a printing error such as a missing or partially printed character, may result. Also, the known configuration uses a powering mode in which a single pulse of long duration is applied to stop rotation of the stepper motor so that printing can be effected. The known printer thus has the disadvantage of consuming large amounts of power.

SUMMARY OF THE INVENTION

In accordance with the present invention, the above problems are solved in a printer mechanism of the aforementioned type in which the type drum of the printer is turned by a four-phase stepper motor so as to successively position a row of types in front of a platen for printing. The types are distributed in columns around the periphery of the type drum and in rows along its length. In one arrangement, sets of the numerals 1, 2, . . . , 9, 0 are aligned around the drum in the columns. In each column, the types of one column are spaced apart by two pitch distances and corresponding types, such as 1's, are displaced peripherally from 1's in adjacent columns by an amount equal to one pitch distance. Rotation of the type drum by one pitch distance therefore results in a succession of like types in the "odd" or the "even" columns being moved into position before the platen for printing.

A first drive cycle of four distinct drive signals is applied to the four phases of the stepper motor to step it in rotation for one pitch distance. A second drive cycle of four distinct drive signals steps the stepper motor a second pitch distance. Thus, the first cycle advances the type drum to position the "even" types for printing, and the second cycle advances the type drum to position the like types in the "odd" columns. The placement of like types, such as "1" in the first and second rows, "2" in the third and fourth rows, etc., makes possible the printing of a "1" or a "2" at any position along the platen by selecting the "1" or the "2" in adjacent columns for printing.

The printer mechanism of the invention includes an arrangement by means of which the type drum may be accurately positioned so that the characters being printed are accurately aligned. In the illustrated embodiment, a plurality of ratchet teeth are provided around the periphery of the stepper motor and a spring-loaded ratchet lever drops into place behind each tooth when the stepper motor turns. Special stop signals reverse the rotation of the stepper motor and the type drum when the motor is being driven in the first cycle or when it is in the second cycle. Each of the stop signals is a combination of a regular, full powering signal of the first or the second drive cycle which is applied out of normal sequence and which thus drives the motor in reverse. The reverse motion drives a ratchet tooth against the ratchet lever, stopping the motor. The full-powering component of the stop signal is followed by a second, reduced-power component which holds the motor in the reverse drive condition.

The stop signals are provided after the fourth or the eighth drive signal of the first and second drive cycles by applying the second drive signal or the sixth drive signal, respectively. These signals are then followed by the signals from the third powering mode or from the seventh powering mode, respectively, at a level which is reduced so as to generate sufficient torque to maintain the ratchet tooth against the reversal blocking lever.

It is an object of the present invention, therefore, to provide a miniature printer in which the locations of types on a type drum are related to the waveforms of the signals applied to a stepper motor to position a sequence of types for printing.

It is still another object of the invention to relate the distances between types around a type drum to a series of distinct signals for driving the phases of a stepper motor so that driving of the stepper motor can be simplified.

It is another object of the invention to provide a compact printer in which, at the time of stopping the stepper motor for printing, a powering mode holds the print drum steady while consuming little power.

It is still another object of the invention to secure quick stopping of the stepper motor by limited reversal of the stepper motor.

It is a further object of the present invention to provide a compact printer which is controlled by a series of successive ON/OFF pulses when stopping the stepper motor for printing, thereby limiting the consumption of power.

BRIEF DESCRIPTION OF THE DRAWINGS

FIG. 1 is a perspective view of an embodiment of a miniature printer in accordance with the present invention;

FIG. 2 is a side view showing details of the reverse motion preventing latch of the printer of FIG. 1;

FIG. 5 is a table showing the relation between the arrangement of types on the type drum and the powering, or driving, modes of the stepper motor;

DETAILED DESCRIPTION OF THE INVENTION

Figure 3B:
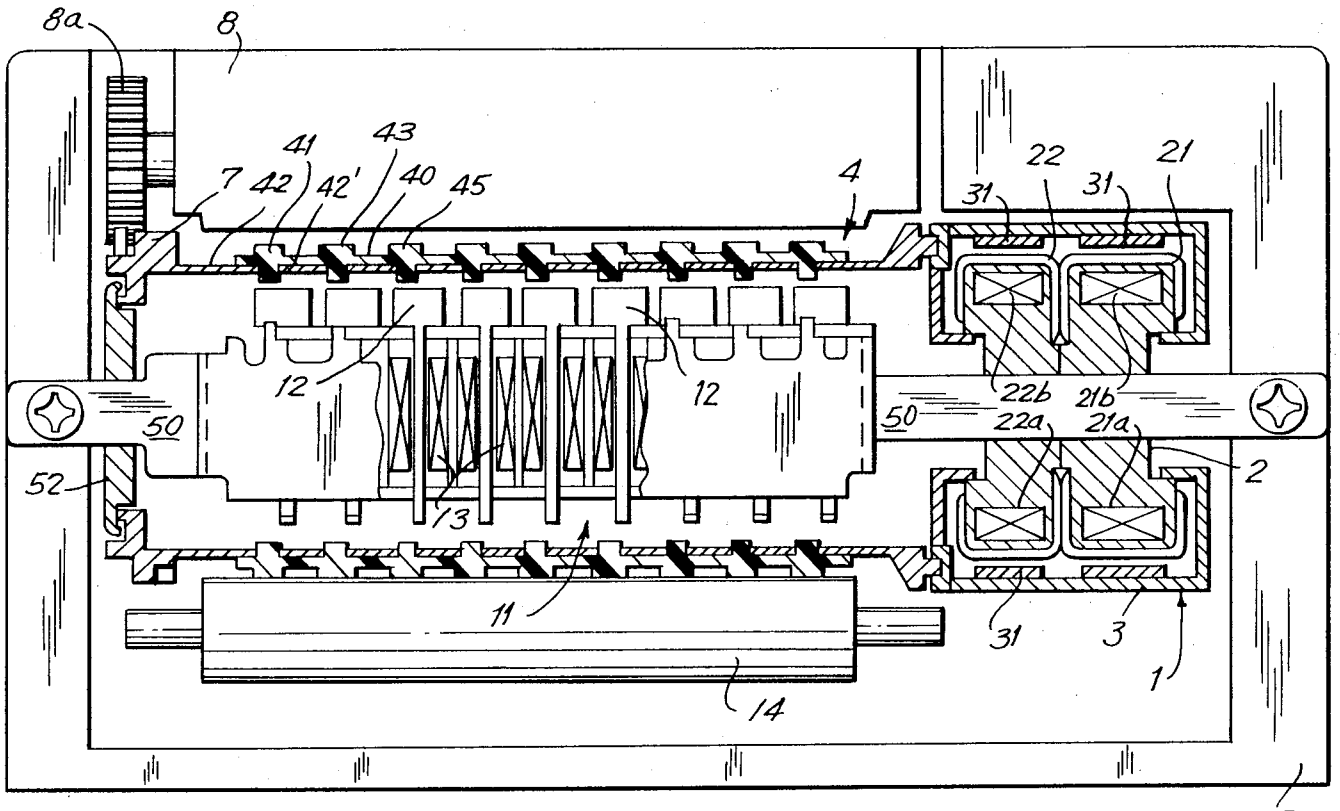
FIGS. 3A and 3B are sectional views taken along lines 3A—3A and 3B—3B of FIG. 1, respectively.
Figure 3A:
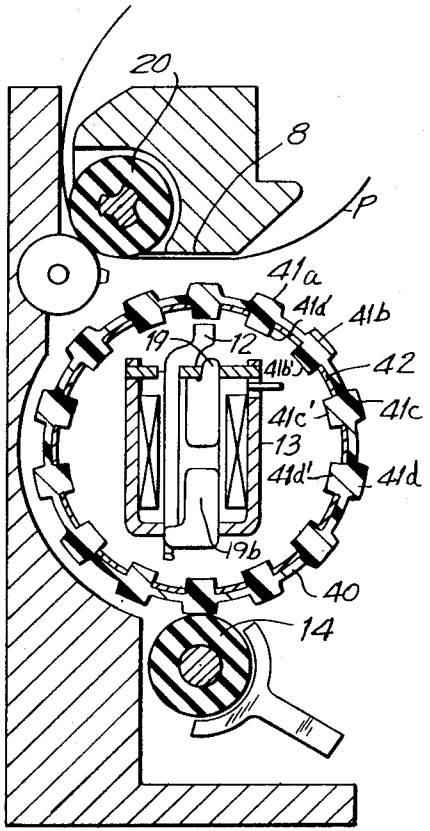
Figure 4:
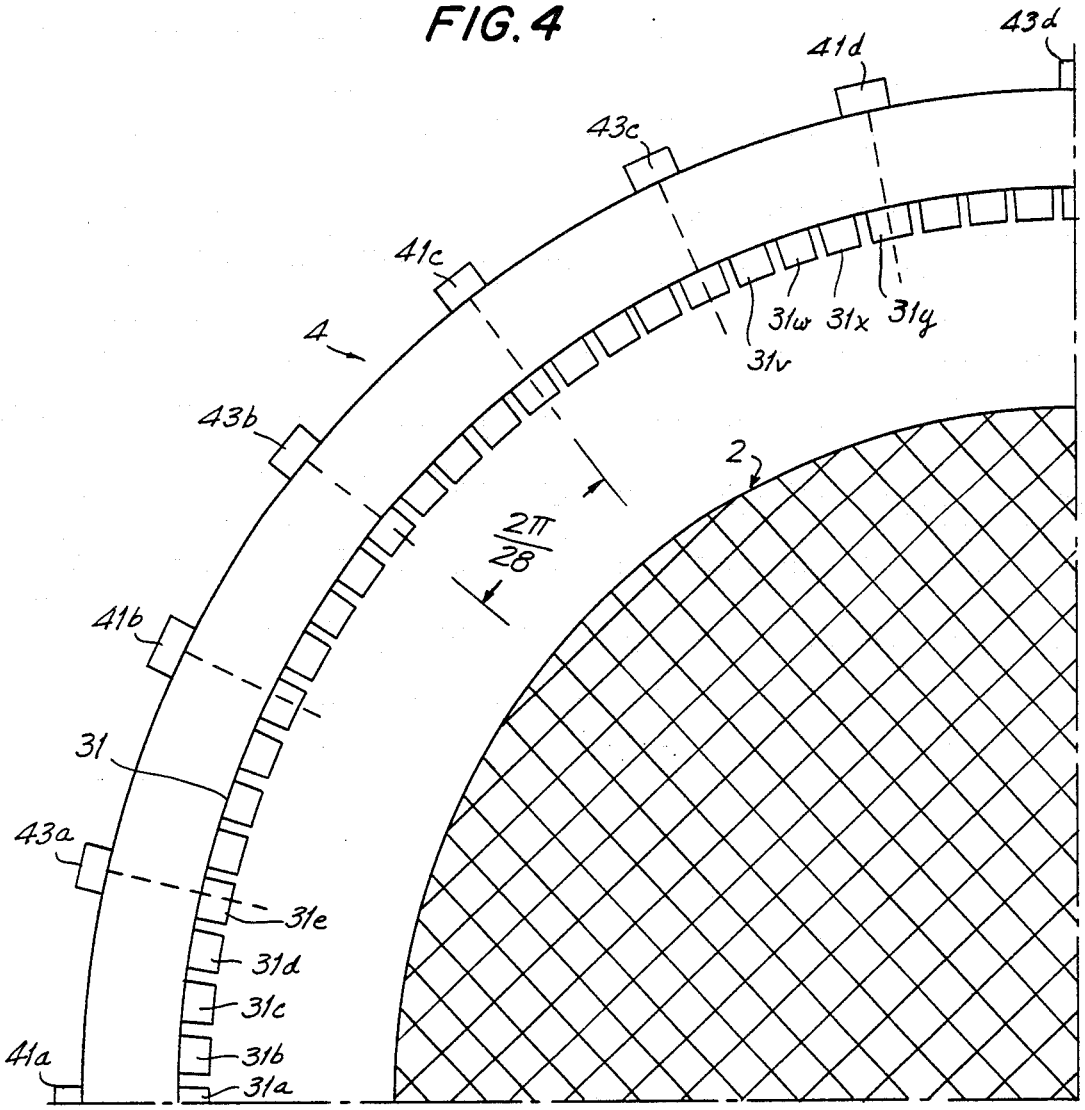
FIG. 4 is schematic sectional representation of a portion of the stepper motor rotor, showing the relationship between the arrangement of the magnetic poles of the stepper motor and the disposition of types on the type drum.

Reference is made first to FIGS. 1, 2, 3A and 3B in which an illustrative embodiment of a printer using the principles of the invention is shown. The printer is driven by a stepper motor 1 which has an outer rotor 3. The armature 2 of motor 1 is secured to a base 5 by means of an axial support 50. The motor has a four-phase armature 2 which includes coil cores 21 and 22 which are joined together and around which four driving coils 21*a*, 21*b*, 22*a* and 22*b* are wound, so that coil pairs 21*a*, 21*b* and 22*a*, 22*b* have a phase difference of 180° in electrical angle. Rotor 3 (FIGS. 3 and 4) carries motor magnets 31 which extend around the inner periphery of the rotor and are divided into equally circumferentially spaced magnetic domains 31*a*, 31*b*, 31*c*, . . . , 31*x*, 31*y*, etc. Rotor 3 is rotatable about armature 2 and can be stopped at any one of the 112 equally spaced positions, or steps, thus provided. Advance of the rotor through four of the steps results in advance of the rotor through an angle of $2\pi/28$. One end of rotor 3 (FIG. 1) is coupled via a plurality of notch connectors 32 to one end of a type drum 4, so that rotation of rotor 3 is directly communicated thereto. Type drum 4, which consists of a hollow cylindrical type belt holder 42 (FIG. 3) and a flexible type sheet 40, is supported at its other end by an end plate 52 for rotation about its common axis with motor 1. Type belt holder 42 has a plurality of holes 42′ in its periphery, into each of which one of a plurality of inwardly directed projections 41′ of type sheet 40, placed around the periphery of the type drum, are fitted. Type sheet 40 has eighteen columns of types 41, 43, 45, . . . on its surface and is flexible so that the types can be forced outward for printing. Each inwardly directed projection 41′ is associated with one type, and can be struck by a hammer 12 to move it outward.

A set of ratchet teeth 33 are equally spaced around the periphery of rotor 3 and are positioned so as to engage a reversal blocking lever 6 which is pivotally supported on base 5 by means of a shaft 6*a* (FIG. 2). Blocking lever 6 is urged into engagement with ratchet teeth 33 by a compression spring 6*b*. The far end of type drum 4 is provided with a single tooth-shaped gear portion 7 which meshes once each drum revolution with a roller drive gear 8*a*. Roller drive gear 8*a* is attached by a shaft 8*b* to one end of a roller 20 (FIG. 3A) and serves to move a sheet of paper in front of a platen 8 (FIG. 3B) at line spacings of one line per revolution of type drum 4. As shown in FIG. 1, a switch 9 serves to detect the home position of type drum 4, being closed when a notch 10′, formed in the inner surface of type drum rim 10, arrives at the home position.

Type sheet 40, which take the form of a belt, is configured on type drum 4 so that each of the respective columns of type 41, 43, 45, . . . , etc. contains a series of fourteen types, such as 41*a*, 41*b*, 41*c*, . . . (FIG. 3B and FIG.4) and such as 43*a*, 43*b*, 43*c*, . . . (FIG. 4) which are spaced equally about the periphery. The types in alternating columns in the axial direction are displaced in the direction of the periphery by an angle of $2\pi/28$ so that types of the same kind appear in a zigzag fashion with an angular difference of $2\pi/28$. This provides an offset or pitch distance of each character position which corresponds to four steps of stepper motor 1 and which is identified as "odd" or "even" in FIG. 5.

The types are actuated for printing by a print striking mechanism 11 which is supported inside of type drum 4 on axial support 50. Print striking mechanism 11 includes a plurality of hammers 12, each of which has a width which spans two columns, being positioned to strike the inwardly projecting portions 41′ of types in adjacent columns. Each hammer 12 (FIG. 3A) is driven by an associated solenoid 13 having an iron core 19*a* which attracts a print attraction board 19*b* when the solenoid is energized. When the attraction board 19*b* moves, the hammer 12 to which it is coupled moves away from the solenoid into contact with an inwardly projecting portion 41′ in one column or the other, causing the associated type to imprint on paper P against platen 8. Ink, which has been applied to the surface of a type from ink roller 14, is thereby transferred to the paper.

Figure 6:
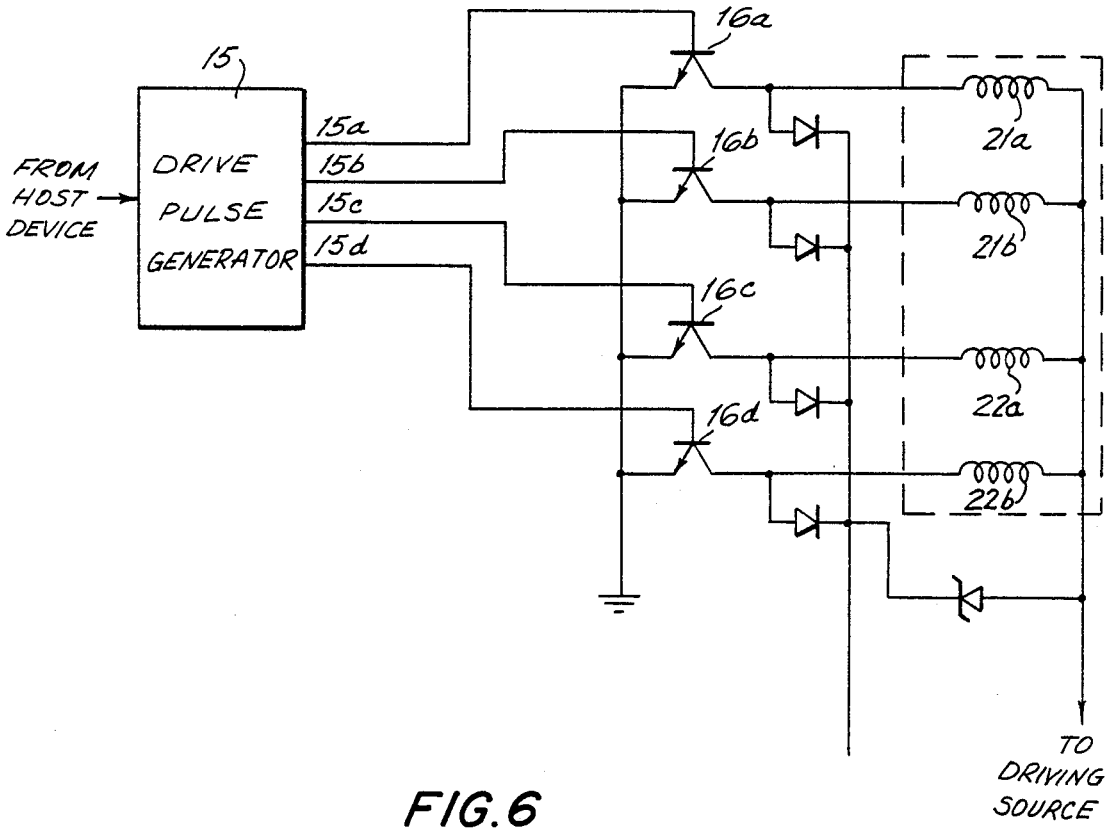
FIG. 6 is a diagram of a control circuit for driving the stepper motor.

A circuit for controlling the stepper motor for FIGS. 1–3, is shown in FIG. 6. In the circuit, a host device, not shown, provides type selection signals to a drive pulse generating circuit 15 which provides a sequence of single-phase and two-phase voltages in alternation to the coils 21*a*, 21*b*, 21*c* and 21*d* of stepper motor 1 to cause it to step four times, rotating through an angle $2\pi/28$. When the type drum is to be stopped for printing, pulse generating circuit 15 energizes stepper motor 1 in the reverse direction using successive two-phase and single-phase voltage combinations. Pulse generating circuit 15 has output terminals 15*a* through 15*d* which are connected to the base electrodes of switching transistors 16*a*, 16*b*, 16*c*, and 16*d*, respectively. The emitters and collectors of transistors 16*a*–16*d* are connected in series with the respective driving coils 21*a*, 21*b*, 22*a* and 22*b*, respectively, of stepper motor 1 and with a power source for the motor, which is not shown. The four phase voltage A, B, C, and D which are variously combined to produce the eight signals of the step powering modes which advance the stepper motor are shown in FIG. 7.

Figure 7:
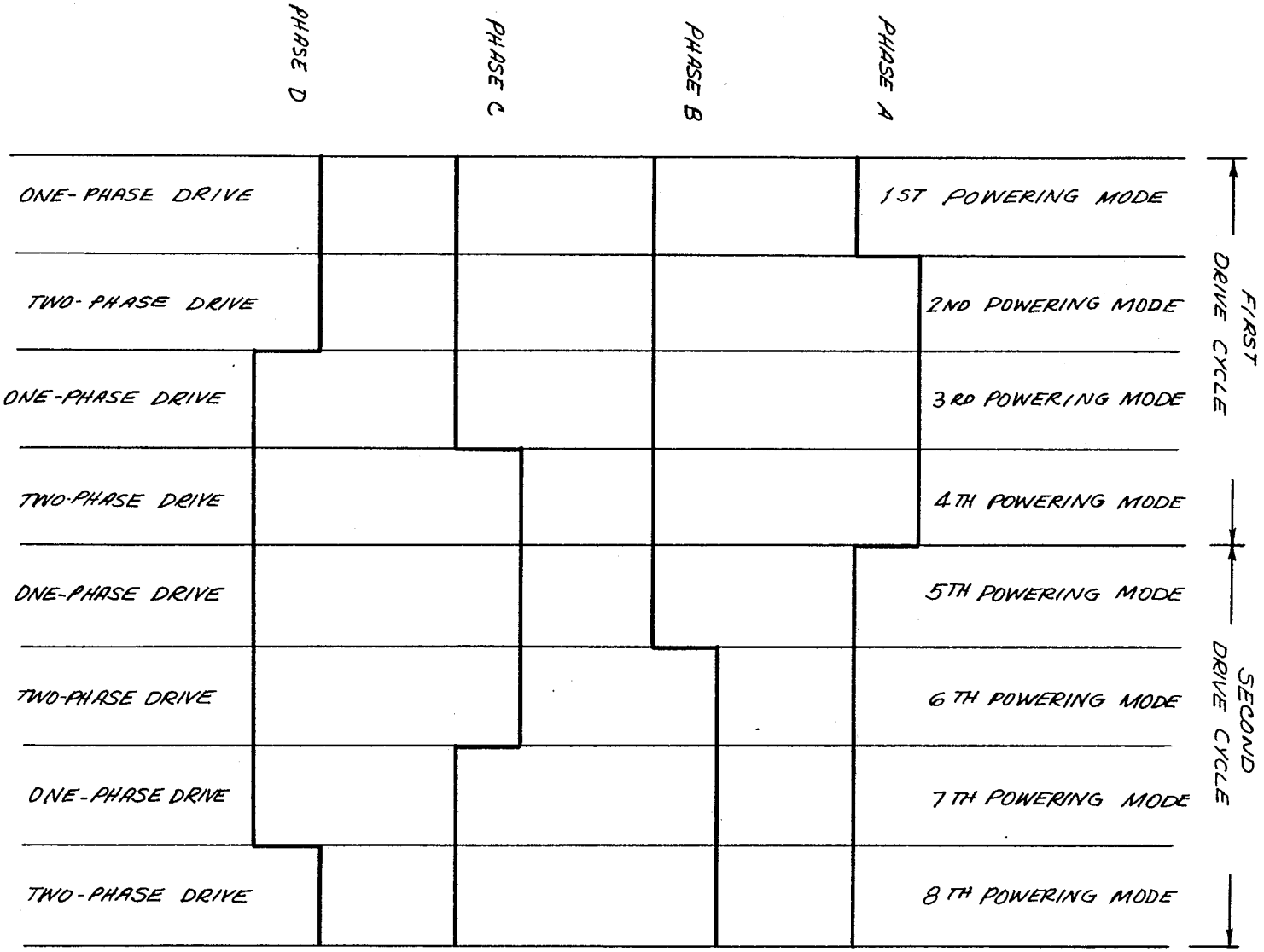
FIGS. 7 and 8 are diagrams showing waveforms of signals output by the control circuit of FIG. 6.

As shown in the driving sequence diagram of FIG. 7, drive pulse generation circuit 15 provides a first drive cycle and a second drive cycle in alternation. The first drive cycle has powering modes one through four. In the first powering mode, phases A, B, and C are OFF and phase D is ON. In the second powering mode, phases B and C are OFF and phases A and D are ON. In the third powering mode, phases B, C, and D are OFF and phase A is ON. In the fourth powering mode, phases B and D are OFF and phases A and C are ON. The second drive cycle has powering modes five through eight. In the fifth powering mode phases A, B, and D are OFF and phase C is ON. In the sixth powering mode phases A and D are OFF and phases B and C are ON. In the seventh powering mode phases A, C and D are OFF and phase B is ON. In the eighth powering mode phases A and C are OFF and phases B and D are ON.

Drive pulse generating circuit 15 also responds to signals from the host device to selectively output first and second stop signals depending upon which drive cycle is to be followed by printing. For example, when terminating driving in the first drive cycle to permit printing after the end of the drive pulse of the fourth powering mode, drive pulse generating circuit 15 produces the first stop signal by first outputting the pulses of the second powering mode out of sequence, thereby reversing the motor and by then outputting the single pulse of the third powering mode in chopped form (FIG. 8A) to continue powering the motor in the reverse direction. To end driving after the second drive cycle, the drive pulse of the eight powering mode, drive circuit 15 produces the pulse of the sixth powering mode and again, while printing is carried out, provides a signal for holding the motor in reverse, by chopping the single pulse of the seventh powering mode into short pulses (FIG. 8(B)).

Figure 9:
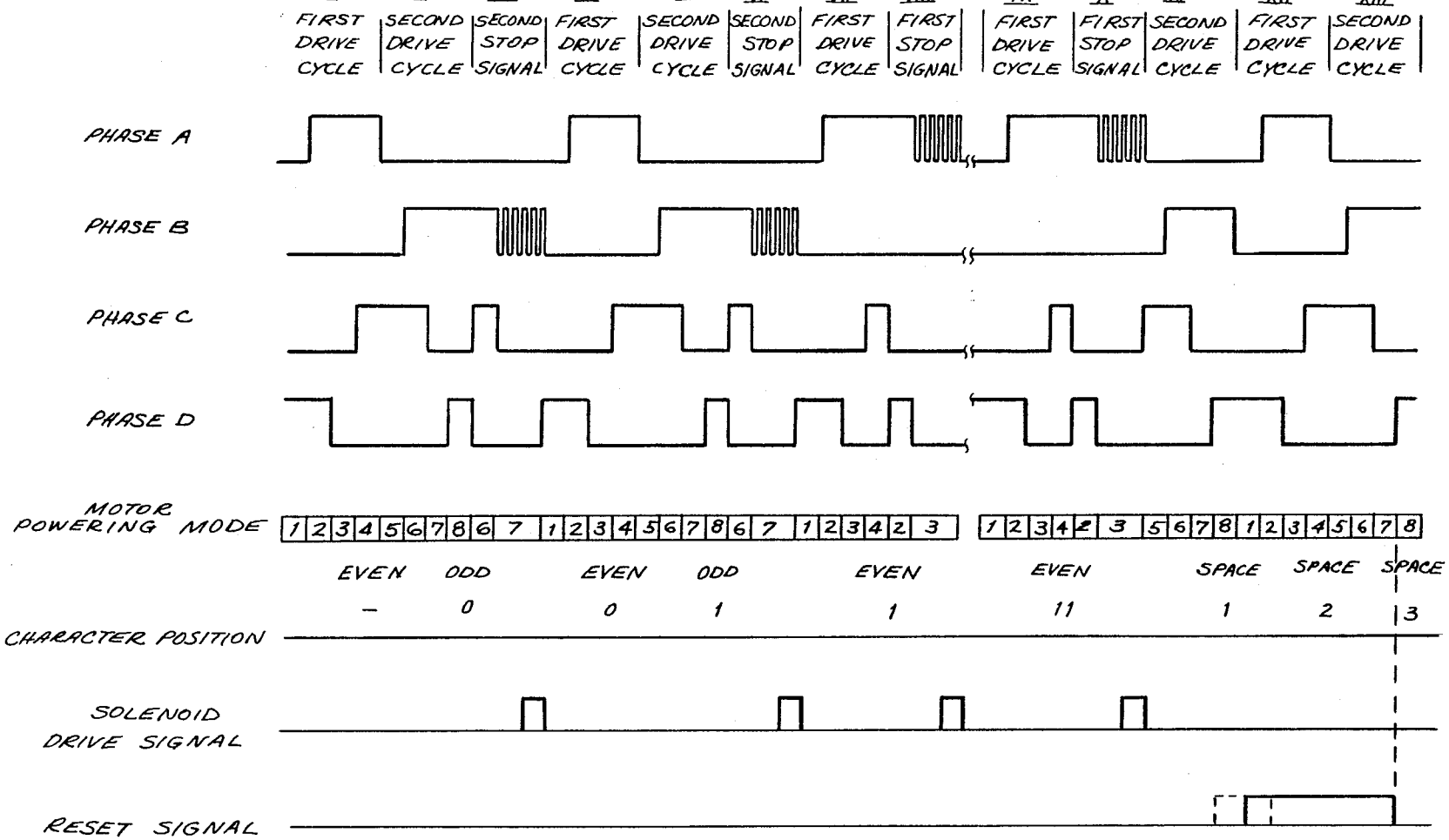
FIG. 9 is a diagram illustrating the timing of a print operation.
Figure 10:
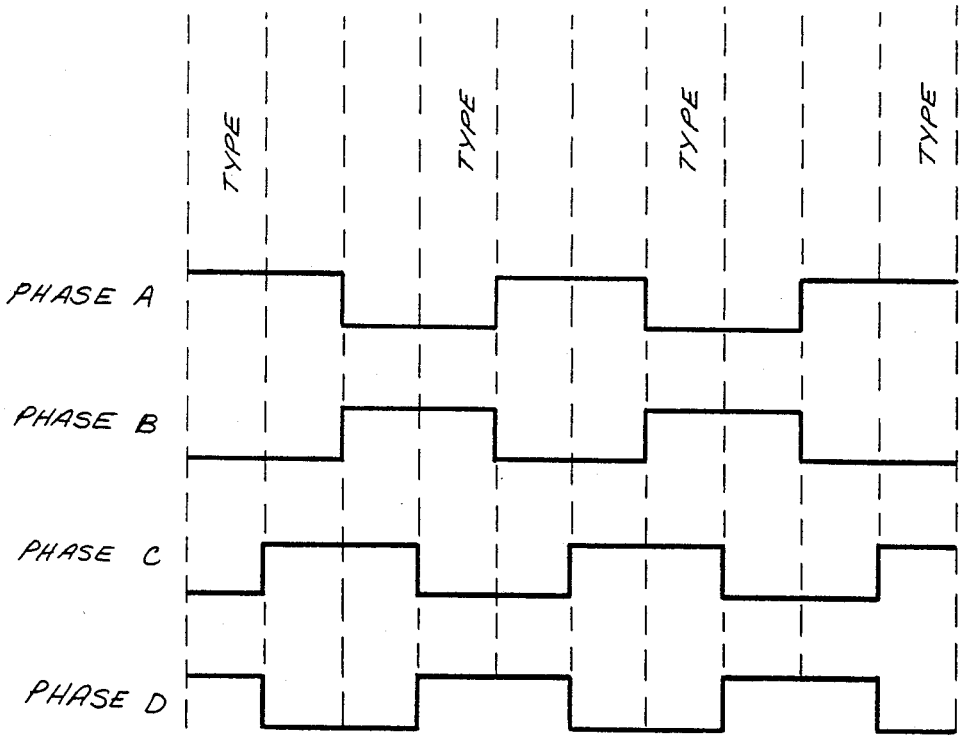
FIG. 10 PRIOR ART
FIG. 10 is a diagram showing the relation between the type positions and the stepper motor driving signals of a conventional stepping-motor-driven printer.

Reference is now made to the timing chart of FIG. 9 where, by way of example, the printing of the number "10.1" is illustrated. Starting with type drum 4 standing still at the home position, when a print command signal is supplied from the host device, drive pulse generating circuit 15 generates signals in the first drive cycle, applying the respective phase signals successively to stepper motor 1 according to the first, second, third, and fourth powering modes. Stepper motor 1 turns type drum 4 in the direction indicated by the arrow marked X (FIG. 2) by an amount corresponding to four steps (I in FIG. 9). Next, drive pulse generating circuit 15 generates the phase signals in the second drive cycle signal and stepper motor 1 is put through the fifth, sixth, seventh and eighth powering modes, thereby causing the stepping motor to again turn by an amount corresponding to four steps (II in FIG. 9). When the eighth powering mode of the second drive cycle signal has been completed, the types "0" in the odd numbered columns (FIG. 5) are located at platen 8 in position for printing. At the moment when the types "0" of the odd numbered columns are opposite platen 8, the tip of reversal blocking lever 6, under the urging of spring 6*b*, falls between ratchet teeth 33. At the same time, drive pulse generating circuit 15 outputs the second stop signal, e.g., pulses in phases C and D of the sixth powering mode, strongly driving stepper motor 1 in rotation in the reverse direction (III in FIG. 9). In response to the large reverse torque so generated, the rear face of ratchet tooth 33, which has just passed the tip of blocking lever 6, engages blocking lever tip surface 6' so that reverse rotation of stepper motor 1 is positively stopped at the predetermined position provided by the blocking lever. As the pulses of the sixth powering mode end, driving circuit 15 outputs a single-phase, chopped pulse in the active phase of the seventh powering mode. The chopped single-phase pulse provides sufficient power for energizing stepper motor 1 to maintain ratchet tooth 33 against reversal blocking lever 6 and to hold type drum 4 stationary during printing. While type drum 4 is thus positioned, the solenoid 13 for driving the respective print hammer 12 for the fifth and sixth columns is energized by separate command from the host device so that the type "0" if the fifth column, e.g., that type of columns 5 and 6 which is in place for printing, is pressed against paper P and printed (III in FIG. 9).

When the printing has been completed, drive pulse generating circuit 15 outputs the signals of the first drive cycle to rotate stepper motor 1 (IV in FIG. 9) by one pitch distance, e.g., four steps, and then outputs the signals of the second drive cycle to continue rotation of stepper motor 1 (V in FIG. 9). When the eight powering mode of the second drive cycle signal has been completed, the types "1" of the odd numbered columns have been brought into place opposite platen 8. The second stop signal is now executed by drive pulse generating circuit 15 to energize stepper motor 1 in the reverse direction and to bring the rear face a ratchet tooth 33 to rest against the tip 6' of reversal blocking lever 6. With the types "1" in the odd numbered columns held in position opposite the platen, the solenoid 13 which is associated with the third and fourth columns is energized, and the "1" of the first digit position is printed (VI of FIG. 9).

When the above printing operation has been completed, drive pulse generating circuit 15 again enters the first drive cycle and starts stepper motor 1 (VII in FIG. 9). When the signal constituting the fourth powering mode has been generated, the types "1" in the even numbered columns of type drum 4 have been moved into printing position opposite platen 8. After the fourth powering mode signal, drive pulse generating circuit 15 generates the two phase pulse of the second powering mode, i.e., the initial portion of the first stop signal. Stepper motor 1 is thus energized in the reverse direction to back ratchet tooth 33 against tip 6' of reversal blocking lever 6. Then the single-phase, chopped pulse of the third powering mode is transmitted to step motor 1 to maintain ratchet tooth 33 in contact with reversal blocking lever 6. While type drum 4 is thus firmly positioned at the location defined by the fourth powering mode, the hammer 13 which associated with the fifth and sixth columns is actuated to print the "1" of the fourth digit position (VIII of FIG. 9).

Having completed the printing of the numerals, drive pulse generating circuit 15 now outputs the signals of the second drive cycle to start rotation of stepper motor 1 and, in succession, alternatingly outputs the signals of the first drive cycle and of the second drive cycle so as to continuously rotate the stepper motor. When the types "." of the even numbered columns arrive in position opposite platen 8 (IX of FIG. 9), the first stop signal, i.e., the two-phase pulse of the second powering mode is output, stopping type drum 4 at a position which is then maintained by the chopped pulse signal of the third powering mode. The hammer associated with the third and fourth columns is then actuated to print the decimal point (X of FIG. 9).

After all of the required types have been selected and printed to complete the print of number "10.1"; type drum 4 has rotated nearly one revolution. Signals of the first and second drive cycles are now generated to rotate type drum 4 to bring single toothed gear 7 of type drum 4 into engagement with driven gear 8*a*. As rotation continues, paper feed roller 20 is turned by driven gear 8*a* by an amount which corresponds to a one line advance of print paper P. At the same time, as the feeding of the paper is completed, notch 10' of type drum 4 (FIG. 1) actuates contact arm 9' of switch 9, providing a reset signal. The signal occurs in periods XI and XII of FIG. 9, as shown by the dashed line. The reset signal is fed to drive pulse generating circuit 15 where it is detected. When the signal for the eighth powering mode of the second drive cycle has been output, the second stop signal is generated and stepper motor 1 is stopped at the home position as defined by the eighth powering mode (XIII in FIG. 9).

Figure 11:
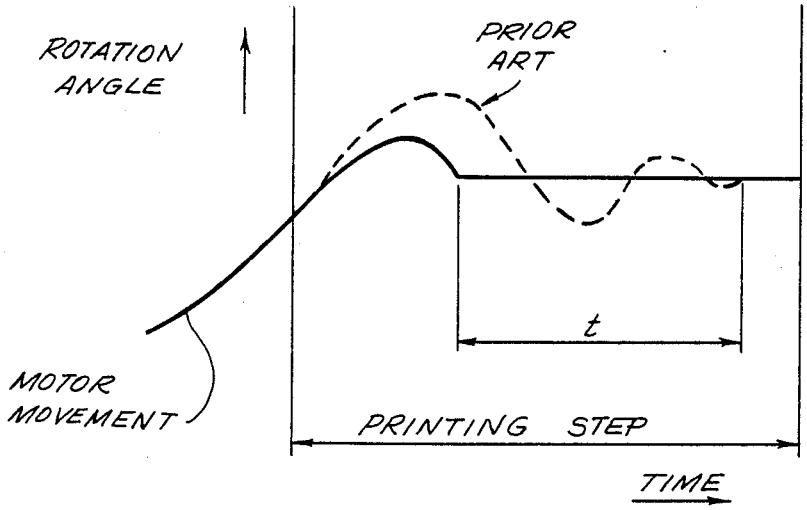
FIG. 11 is a graphic comparison of the stopping motion of the stepper motor rotor of the invention with that of a conventional printer.

As described above, when step motor rotor 3 is stopped to permit printing, a reverse powering mode is provided which drives the motor rotor 3 and type drum 4 in reverse. Because of the interaction of ratchet teeth 33 of rotor 3 with reversal blocking lever 6, rotor 3 and type drum 4 are quickly turned backward to a precise, predetermined position. The effect of this feature of the invention can be seen in FIG. 11, where the movement of rotor 3 in rotation is plotted against time by means of the solid curve. Comparison with the broken curve, which represents the movement of a prior art rotor, shows that the rotor 3 of the invention becomes stationary by a time t earlier than does the conventional rotor.

Figure 8:
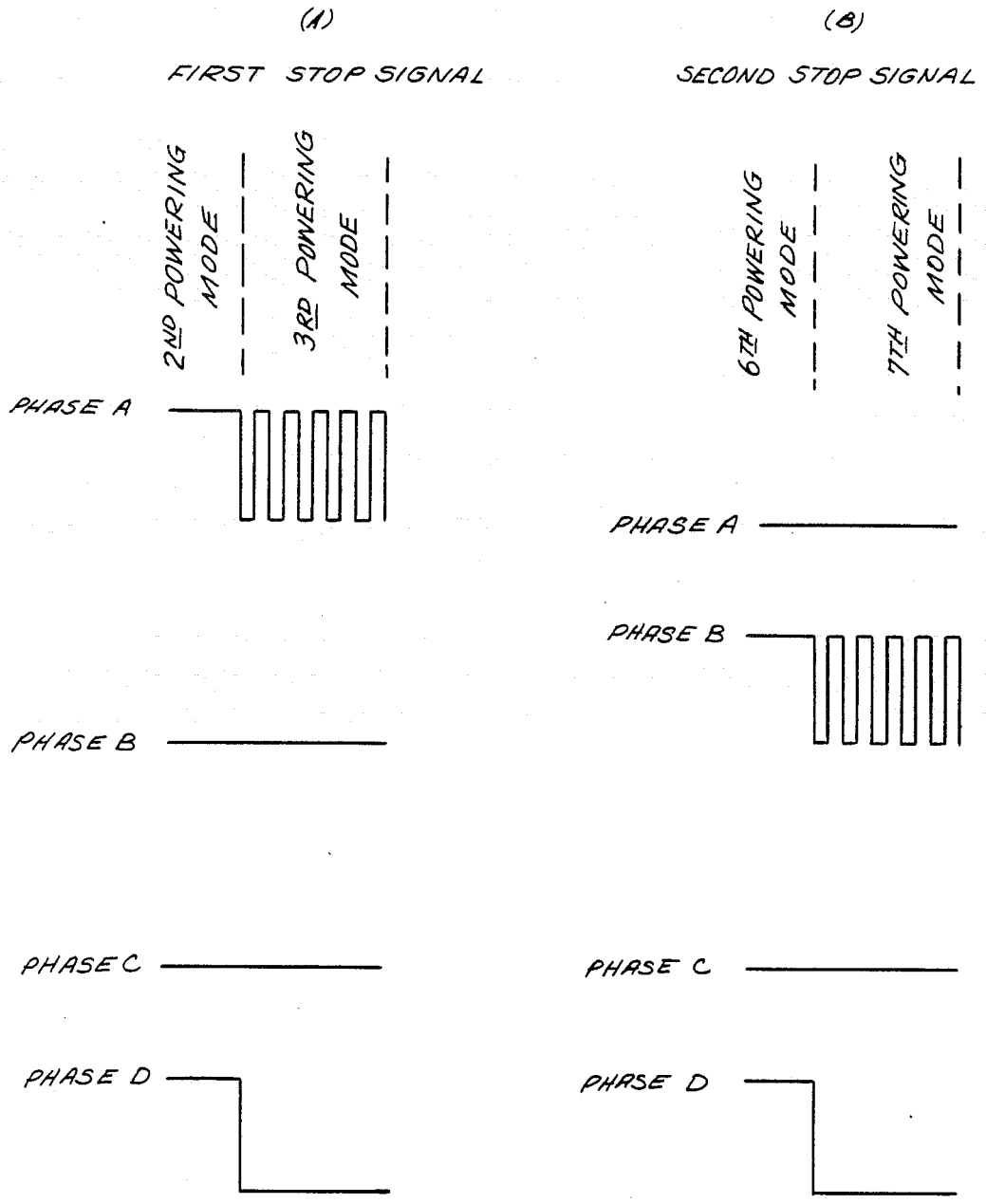
Figure 12:
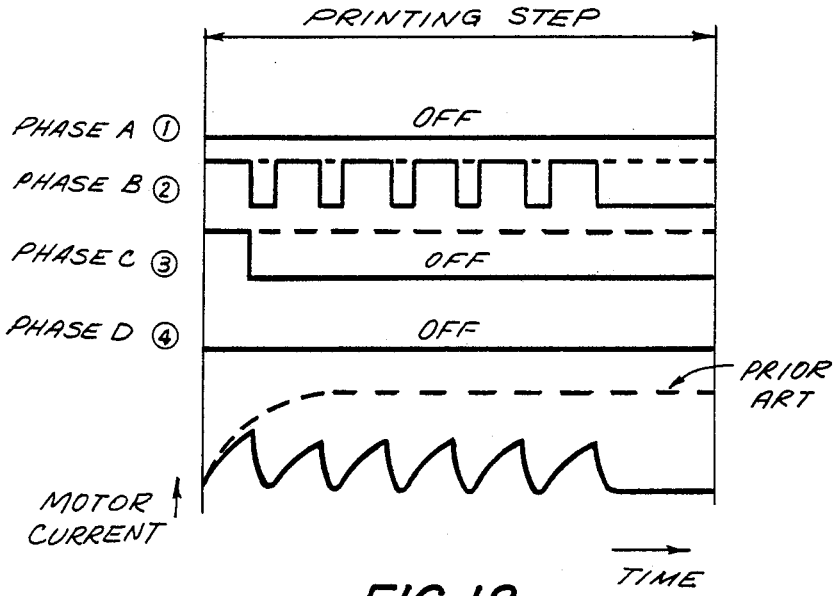
FIG. 12 is a graph showing stepper motor current consumption of the present invention as compared with the current consumption of the prior art.

As is shown in FIG. 8, the present invention employes a signal in the reverse powering mode which includes a series of ON/OFF pulses for energizing rotor 3 at a reduced level during the period of printing, whereby a ratchet tooth 33 is engaged by reversal blocking lever 6. As a result of the use of this chopped signal, the average current consumed by the rotor 3, while stopped, is that shown by the solid, saw-tooth like curve at the bottom of FIG. 12. As stated previously, after the motor is reversed, the current in the other three phases of the motor is turned off, while only one of the phases A or B, the latter being illustrated in FIG. 12, is energized. The average current consumed by rotor 3 in this mode is thus much less that that consumed in a conventional stepping motor where the holding current is always ON, as shown by the broken line marked "prior art".

While the foregoing description of the invention characterizes the drive pulses in the first, second, third, and fourth powering modes as being output successively in the designated order during the first drive cycle and drive pulses of the fifth, sixth, seventh, and eighth powering modes as being output successively in the designated order during the second drive cycle, it will be understood by those skilled in the art that it is possible to employ the two phase-pulses of the second powering mode and of the fifth powering mode as starting pulses without causing desynchronization of the stepper motor. It will also be clear that, whereas an outer rotor stepper motor has been shown in the illustrative embodiment as coupled directly to the type drum, the desired effect of the invention can be obtained whether the outer rotor or the inner of a stepper motor is coupled directly, or by way of a transmission, to the type drum. Further, although the invention is illustrated in connection with an embodiment in which the periphery of the type drum is divided into twenty-eight equal portions at which types are located, it will be apparent that a different number of divisions can be employed.

As described above, the present invention describes a construction in which the pitch distance at which the types are spaced is traversed by four steps of a stepper motor as it is driven by four phase signals. The relation between the powering modes for energizing the stepper motor and the positions of the type is thus unequivocally defined. Therefore, the home position is known with a high degree of precision even when the position detector outputs a signal which is in only rough correspondence with the position of the type drum, since the number of steps through which the rotor moves corresponds to the number of phases of the stepper motor. Also, because the rotor can be stopped exactly and quickly for printing by the combined action of the powering modes, which cause stopping and reverse rotation, and of the ratchet teeth on the stepper motor rotor and the blocking lever, which positions the rotor, the present invention provides a printer which is capable of very high printing speed. Since the rotor is always stopped at precisely the same position, the linearity of printed characters is excellent, while a proper positional relationship is maintained between the print hammers and the rearward projections of the type sheet. In all, the present invention thus provides for a miniature printer which produces a high quality of printing with no missing characters and high reliability. Finally, because the powering mode of stopping and reversing rotation of the stepper motor utilizes repeated pulses instead of direct current, the present invention provides a printer which uses very little power and consequently runs cool.

It will thus be seen that the objects set forth above, among those made apparent from the preceding description, are efficiently attained and, since certain changes may be made in the above constructions without departing form the spirit and scope of the invention, it is intended that all matter contained in the above description or shown in the accompanying drawing shall be interpreted as illustrative and not in a limiting sense.

It is also the be understood that the following claims are intended to cover all of the generic and specific features of the invention herein described and all statements of the scope of the invention which, as a matter of language, might be said to fall therebetween.

What is claimed is:

1. A printer mechanism comprising:

type drum means for supporting a plurality of types rotatable about an axis;

a plurality of types positioned at regular spaced intervals about the periphery of the type drum means;

a printing position adjacent the type drum means;

stepper motor means for rotating the type drum means in steps to move a type into the printing position, the stepper motor means comprising a predetermined number of phases, the pitch between circumferentially successive types being equal to a predetermined number of steps, the predetermined number of steps being equal to the number of phases of said motor means;

driving means for applying a series of distinct driving signals to the phases in a predetermined sequence to produce the predetermined number of steps to rotate the type drum means to sequentially position the spaced types at the printing position said signals forming a first drive cycle and and a second drive cycle, each drive cycle consisting of four powering modes whereby during each power mode of a cycle a distinct phase or plurality of phases is energized by the driving means; and whereby during the driving of the stepper motor means, the types selected to be positioned in the printing position are positioned by controlling the stepper motor means using the fourth powering mode of each drive cycle, one powering mode of each drive cycle causing the type drum means to be rotated through a pitch and a second powering mode causing the type drum to stop.

2. The printer mechanism of claim 1 in which the stepper motor means and the type drum means rotate in one-to-one correspondence.

3. The printer mechanism of claim 1 and further comprising:

means for supporting paper to receive printing; and means for moving the paper and a type which has been positioned for printing relative to one another to execute printing.

4. The printer mechanism of claim 1 in which the types are disposed in at least two parallel columns around the periphery of the type drum means, each type in one column being spaced circumferentially from a corresponding type in a the other column by one pitch distance, the predetermined number of steps rotating the type drum means by one pitch distance to move a type in one column away from printing position while moving a type in the other column into printing position.

5. The printer mechanism of claim 4 and further comprising:

hammer means positioned to strike whichever of the types in adjacent columns is in printing position.

6. The printer mechanism of claim 1 in which the driving means provides at least one driving signal for driving the type drum means in the reverse direction.

7. The printer mechanism of claim 6 in which the sequence of the driving signals for advancing the type drum means is predetermined and in which the reverse driving signal comprises at least one forward driving signal taken out of sequence.

8. The printer mechanism of claim 1 in which each phase of the stepper motor means comprises a winding in which each of the driving signals comprises either a single or a pair of driving voltages, each voltage having a distinctive waveform, the voltages being applied in a predetermined sequence to the windings to produce forward rotation.

9. The printer mechanism of claim 6 in which the stepper motor means comprises a winding, in which each of the driving signals comprises either a single or a pair of driving voltages, each voltage having a distinctive waveform, the voltages being applied in a predetermined sequence to the windings to produce forward rotation, and in which the reverse driving signal comprises a single or a pair of driving voltages taken out of sequence.

10. The printer mechanism of claim 9 and further comprising:

blocking means on one of the type drum means and the stepper motor means for holding the type drum means in printing position when the stepping motor means is reversed.

11. The printer mechanism of claim 9 and further comprising:

ratchet teeth on one of the type drum means and the stepper motor means; and lever means for engaging the ratchet teeth when the stepping motor means is reversed, whereby the type drum means is stabilized for printing.

12. The printer mechanism of claim 1 in which the driving means provides signals to the stepper motor means to drive the type drum means in reverse; and further comprising blocking means coupled to one of the type drum means and the stepper motor means for stopping reverse rotation of the type drum means when the stepper motor means is driven in reverse.

13. The printer mechanism of claim 12 wherein the blocking means comprises:

ratchet teeth on one of the type drum means and the stepping motor means; and ratchet member means for engaging one of the ratchet teeth wherein the type drum means moves in the reverse direction.

14. The printer mechanism of claim 12 wherein the circuit means first applies full power to the stepper motor means to drive the type drum means in the reverse direction and then applies power at a reduced level to maintain the type drum means in blocked condition.

15. The printer mechanism of claim 4 in which the types in each of the at least two columns are equally pitched, the stepper motor means having four phases.

16. The printer mechanism of claim 15 in which the driving means provides at least one reversing signal for positioning the type drum means for printing.

17. The printer mechanism of claim 16 in which the reversing signal comprises a signal for advancing the type drum means which is taken out of sequence.

18. The printing mechanism of claim 15 in which each signal for advancing the type drum means comprises one of a single driving voltage and paired driving voltages selected from a group of at least four driving voltages which are pulsed ON at different times but at the same rate so as to be only partially overlapping, a selected single driving voltage being applied to one phase and paired driving voltages being applied to two phases.

19. The printing mechanism of claim 17 in which each signal for advancing the type drum means comprises one of a single driving voltage and paired driving voltages selected from a group of at least four driving voltages which are pulsed ON at different times but at the same rate so as to be only partially overlapping, a selected single driving voltage being applied to one phase and paired voltages being applied to two phases, the reverse signal comprising at least one of the driving voltages taken out of sequence.

20. A printer mechanism comprising:

type drum means for supporting a plurality of types supported for rotation about its axis;

a plurality of types disposed at spaced interval in at least one column about the periphery of the type drum means;

a printing position adjacent the type drum means stepper motor means coupled to the type drum means about the axis comprising a predetermined number of phases, the pitch between the circumferentially successive types being equal to a predetermined number of steps, the predetermined number of steps being equal to the number of phases of said motor means;

blocking means coupled to one of the type drum means and the stepper motor means for preventing reverse motion thereof;

circuit means for driving the stepper motor means, the circuit means driving the stepper motor means in reverse at the time of printing so that the blocking means stops the type drum means in printing position;

the circuit means producing a predetermined number of drive signals, each drive signal consisting of four powering modes whereby during each power mode of a drive signal a distinct phase or plurality of phases is energized by the circuit means; and whereby during the driving of the stepper motor means, the types selected to be positioned in the printing position are positioned by controlling the stepper motor means using the fourth powering mode of each respective drive signal, one powering mode of each drive signal causing the print drum means to be rotated through a pitch and a second powering mode causing the the type drum means to rotate in reverse.

21. The printer mechanism of claim 20 and further comprising:

support means on which at least one of the type drum means and the stepper motor means is rotatably supported the blocking means being coupled to the support means.

22. The mechanism of claim 20 in which the blocking means further comprises:

ratchet means coupled to at least one of the type drum means and the stepper motor means means for rotation therewith; and lever means coupled to the support means and interacting with the ratchet means when the stepper motor is driven in reverse.

23. The printer mechanism of claim 20 in which the stepper motor means comprises a plurality of phases and in which the circuit means applies an intermittent voltage to one of the phases after the stepper motor means is stopped, whereby the type drum means is maintained in printing position.

24. The printer mechanism of claim 20 in which the types are disposed in at least two parallel columns around the periphery of the type drum means, each type in one column being spaced circumferentially from a corresponding type in a the other column by one pitch distance, the predetermined number of steps rotating the type drum means by one pitch distance to move a type in one column away from printing position while moving a type in the other column into printing position.

* * * * *